US007198216B2

(12) United States Patent
Virving

(10) Patent No.: US 7,198,216 B2
(45) Date of Patent: Apr. 3, 2007

(54) REFINING ELEMENT

(75) Inventor: Nils Virving, Hässelby (SE)

(73) Assignee: Metso Paper, Inc. (FI)

( * ) Notice: Subject to any disclaimer, the term of this patent is extended or adjusted under 35 U.S.C. 154(b) by 0 days.

(21) Appl. No.: 10/555,195

(22) PCT Filed: May 5, 2004

(86) PCT No.: PCT/SE2004/000678

§ 371 (c)(1),
(2), (4) Date: Nov. 1, 2005

(87) PCT Pub. No.: WO2004/103567

PCT Pub. Date: Dec. 2, 2004

(65) Prior Publication Data

US 2006/0202074 A1 Sep. 14, 2006

(30) Foreign Application Priority Data

May 23, 2003 (SE) ..... 0301525

(51) Int. Cl.
*B02C 7/12* (2006.01)

(52) U.S. Cl. ..... 241/261.2; 241/298

(58) Field of Classification Search ..... 241/261.2, 241/261.3, 296, 297, 298
See application file for complete search history.

(56) References Cited

U.S. PATENT DOCUMENTS

| | | | | |
|---|---|---|---|---|
| 4,023,737 | A | 5/1977 | Leider et al. | |
| 4,712,745 | A * | 12/1987 | Leith | 241/261.3 |
| 5,165,592 | A | 11/1992 | Wasikowski | |
| 5,467,931 | A | 11/1995 | Dodd | |
| 5,690,286 | A | 11/1997 | Dodd et al. | |
| 6,592,062 | B1 * | 7/2003 | Virving | 241/261.3 |

FOREIGN PATENT DOCUMENTS

| | | | |
|---|---|---|---|
| FI | 53469 | A | 1/1978 |
| SE | 513 807 | C2 | 11/2000 |
| WO | WO00/56459 | * | 9/2000 |

* cited by examiner

*Primary Examiner*—Faye Francis
(74) *Attorney, Agent, or Firm*—Lerner, David, Littenberg, Krumholz & Mentlik, LLP

(57) ABSTRACT

Refining elements for use with disc refiners for the processing of fibrous materials are disclosed. The refining element include a refining surface having a plurality of bars and intermediate grooves, with the bars having an upper surface and a pair of side surfaces defining longitudinal edges, with the plurality of bars including a plurality of recesses disposed along at least one of the longitudinal edges, the recesses including open portions in both the upper surface and one of the side surfaces thereof.

7 Claims, 1 Drawing Sheet

REFINING ELEMENT

CROSS-REFERENCE TO RELATED APPLICATIONS

The present application is a national phase entry under 35 U.S.C. § 371 of International Application No. PCT/SE04/000678 filed May 5, 2004, published in English, which claims priority from Swedish Patent Application No. 0301525-2 filed May 23, 2003, all of which are incorporated herein by reference.

FIELD OF THE INVENTION

The present invention relates to refiners of the disc-type, with opposed refining discs rotating relative to one another. The refining discs are provided with refining elements, which between themselves form a refining gap with a refining zone for working fibrous material. The fibrous material preferably is lignocellulosic fibrous material and the refiner is used for the manufacture of, for example, reject pulp, recycled fiber pulp and mechanical pulps, such as board pulp, thermomechanical pulp (TMP) and chemi-thermo-mechanical pulp (CTMP) and for low-concentration refining chemical pulps.

The present invention, more precisely, relates to a refining element for use in a refiner of the above kind.

BACKGROUND OF THE INVENTION

A refining element is generally formed with a pattern of bars and intermediate grooves. The bars and grooves are formed in different ways, depending on which fibrous material is worked and the degree of refining desired and, thus, in the case of lignocellulosic material, the pulp quality which is desired. The bars have an upper surface and side surfaces so that longitudinal edges are formed between the upper surface and respective side surface. The bars can be, for example, continuous or discontinuous, and can be arranged in different patterns. The working of the fibrous material is substantially carried out by the bars of the refining elements. The refining gap is formed so that the fibrous material, seen in the radial direction, passes from the inside outwardly. Farthermost inward in the refining gap the refining elements are normally formed so as to bring about a first disintegration of the material and to advance the material outwardly in the refining gap. A certain defibering, i.e. separation of the fibers of the lignocellulosic material, also takes place in the inner portion of the refining gap where the distance between the refining surfaces is the greatest. Thereafter, that distance decreases outwardly in order that the desired working or refining of the fibrous material shall be obtained.

During the refining of fibrous material of high concentration, and above all at high energy inputs, it has been found necessary to place flow restrictions, so-called dams, in the grooves of the refining elements in order to prevent unworked material from passing out through the refining gap. These dams, however, form an obstacle for the steam developing in the refining gap during the refining. A high steam pressure is thereby created in the refining gap. This high steam pressure has a negative effect on the capacity and operational stability of the refiner. It also implies a limitation on the possible energy input. The developed steam, thus, will be forced by the flow restrictions upwardly out of the grooves, and will disturb the material flow through the refining gap.

One way of solving this problem would be to supply dilution water to the refining gap in order to thereby condense the steam. This, however, results in reducing the material concentration to a low level, and thus in a deteriorated pulp quality.

During the working or refining of fibrous material with low concentration no steam development takes place, and the material is partially transported by the liquid flow out of the refining gap. Also in this case dams are usually used to prevent unworked material from passing out through the refining gap. It can imply, however, that the flow through the refining gap will be much too low.

SUMMARY OF THE INVENTION

In accordance with the present invention, these and other objectives have now been realized by the discovery of a refining element for use with disc refiners for the processing of fibrous materials, the refining element comprising a refining surface including a plurality of bars and intermediate grooves therebetween, the plurality of bars including an upper surface and a pair of side surfaces defining longitudinal edges therebetween, the plurality of bars including a plurality of recesses disposed along at least one of the longitudinal edges, the plurality of recesses including open portions in both the upper surface and one of the side surfaces thereof. In a preferred embodiment, the plurality of recesses are disposed along only one of the longitudinal edges. In another embodiment, the plurality of recesses are disposed along both of the longitudinal edges.

In accordance with one embodiment of the refining element of the present invention, the upper surface includes a predetermined central point substantially at the center of the upper surface of the plurality of bars, and wherein the plurality of recesses extend inwardly from the one of the side surfaces to the predetermined central point.

In accordance with another embodiment of the refining element of the present invention, the plurality of recesses have a depth of from 2 to 5 mm as measured from the longitudinal edge.

In accordance with another embodiment of the refining element of the present invention, the plurality of recesses have a width of from 2 to 5 mm.

In accordance with another embodiment of the refining element of the present invention, the plurality of recesses are spaced apart a distance of from 1 to 10 mm.

In accordance with another embodiment of the refining element of the present invention, the plurality of recesses form an angle of from 45° to 90° with respect to the plurality of bars, as measured in the intended direction of flow of the fibrous material along the refining surface. Preferably, the plurality of recesses are disposed substantially across the plurality of bars.

The present invention offers a solution to the above problems. According to the present invention, the bars are provided with a plurality of recesses, which are arranged in the longitudinal edges of the bars. The recesses are directed across the bars or so as to form an angle of at least 45° with the bars. The recesses are open both to the upper surface of the bars and to one side surface or to both side surfaces. By this configuration of the bars the flow of the fibrous material through the refining gap will be braked, so that the stay-time of the fibers in the refining gap will be longer and the working thereby will be increased, without braking the steam or liquid flow in the grooves between the bars so that the flow of the fibrous material is disturbed.

The recesses can be placed, for example, along the entire length of the bars or can be broken off by small portions without recesses, measured in the longitudinal direction of the bars. Each recess can have a constant or a varying depth along the bars in the upper surface and side surfaces of the bars. The recesses can be formed only on one side or on both sides of the bars.

When the recesses are formed only on one side of the bars, the direction of rotation of the refining discs carrying the refining elements cannot be changed. Such a configuration, however, can still be suitable with a view to strength.

BRIEF DESCRIPTION OF THE DRAWINGS

The present invention is described in greater detail in the following detailed description which, in turn, refers to the accompanying Figures illustrating some embodiments of the present invention, as follows.

DETAILED DESCRIPTION

Figure 1:
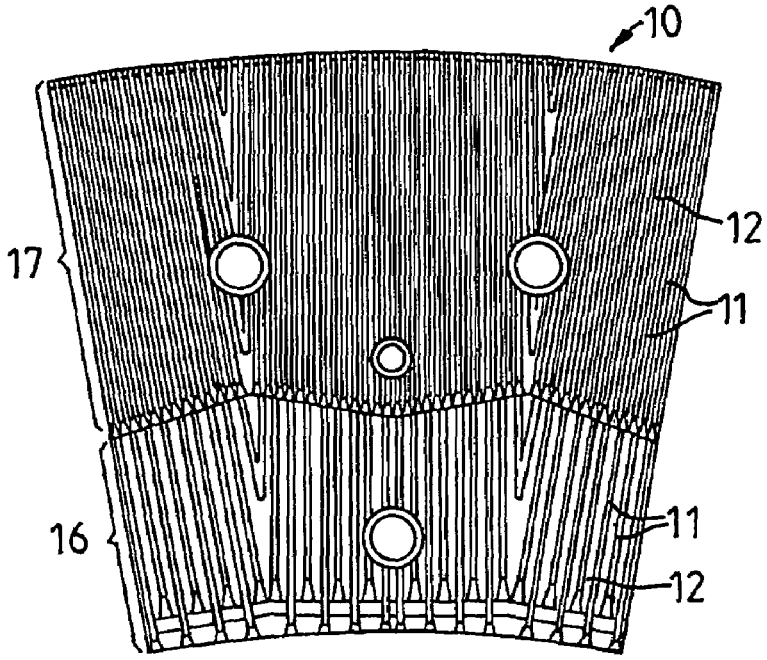
FIG. 1 is a top, elevational, front side view of a refining segment with a pattern of bars and intermediate grooves.

FIG. 1 shows a refining element 10 intended for refining fibrous material having a high concentration. The refining element 10 is provided with a pattern of bars 11 and intermediate grooves 12, in which the bars have upper surfaces 13 and side surfaces 14 with edges 15. The pattern is divided into two zones, an inner zone 16 and an outer zone 17, where the bars and grooves in the inner zone are coarser than in the outer zone. The bars in the inner zone are intended to bring about a first disintegration of the material and to advance the material outwardly to the outer zone. The bars in the outer zone are more tightly arranged, which yields more bar edges for effecting the substantial working and refining of the fibrous material. The pattern can also comprise more zones, where the pattern is usually made tighter from zone to zone, as seen radially outwardly.

Figure 2:
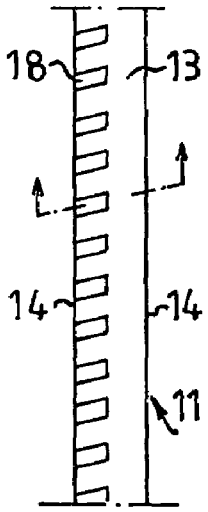
FIG. 2 is an enlarged, top, elevational view of the upper surface of the bars used in the present invention.

FIG. 2 shows one embodiment of a bar 11 on a refining element according to the present invention. Along the bar 11 a plurality of recesses 18 are placed. The recesses are arranged slightly angularly in relation to the longitudinal direction of the bars and are open both to the upper surface 13 and the side surface 14. The recesses can suitably extend to about the center of the upper surface of the bar. The depth of the recesses, as measured from the edge, are one or some millimeters, preferably 2–5 mm. The width should also be one or more millimeters, preferably 2–5 mm. Bars thereby have toothed edges. The distance between adjacent recesses should be 1–10 mm, preferably 2–5 mm.

Figure 3:
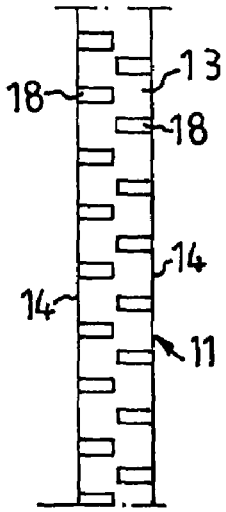
FIG. 3 is an enlarged, top, elevational view of the upper surface of the bars of another embodiment of the present invention.

FIG. 3 shows another embodiment of a bar 11. As compared to FIG. 2, in this case the recesses 18 are located at both edges 15 of the bar, so that both edges of the bar are toothed. As regards the configuration of the recesses, the same dimensions apply as in the case of the FIG. 2 embodiment. In this case, the recesses on opposed edges 15 are suitably offset, so that they do not lie directly in front of each other. This implies that a refining element with such bars can rotate in both directions.

Figure 4:
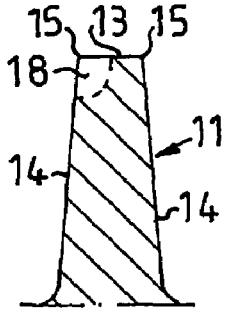
FIG. 4 is a side, elevational, cross-sectional view of one alternative of the embodiment shown in FIG. 2.
Figure 5:
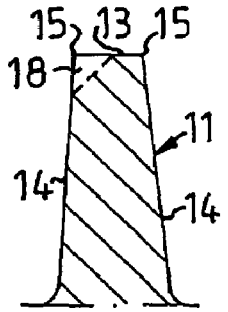
FIG. 5 is a side, elevational, cross-sectional view of another alternative of the embodiment shown in FIG. 2.

The form of the bottom of the recesses 18 can be rectilinear, as shown in FIG. 4, or curved, as shown in FIG. 5. Other forms can also be imagined. The recesses are arranged across the bars or form an angle of at least 45° with respect to the longitudinal direction of the bars. This applies primarily to the surface, which outwardly defines a recess 18, as measured in the direction of flow of the material. When the recesses 18 are angular, they extend from the side surfaces 14 obliquely outwardly, as measured in the direction of flow of the material.

Bars with a configuration according to the present invention can be placed on any zone on the refining element, but preferably in an outer zone where the working and refining are most intensive and the distance between opposed refining elements is the shortest, i.e. where the refining gap is the smallest and the steam development the greatest.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A refining element for use with disc refiners for the processing of fibrous materials, said refining element comprising a refining surface including a plurality of bars and intermediate grooves therebetween, said plurality of bars including an upper surface and a pair of side surfaces defining longitudinal edges therebetween, said plurality of bars including a plurality of recesses disposed along at least one of said longitudinal edges, said plurality of recesses having a width of from 2 to 5 mm and being spaced apart a distance of from 1 to 10 mm and including open portions in both said upper surface and one of said side surfaces thereof.

2. The refining element of claim 1 wherein said plurality of recesses are disposed along only one of said longitudinal edges.

3. The refining element of claim 1 wherein said plurality of recesses are disposed along both of said longitudinal edges.

4. The refining element of claim 1 wherein said upper surface includes a predetermined central point substantially at the center of said upper surface of said plurality of bars, and wherein said plurality of recesses extend inwardly from said one of said side surfaces to said predetermined central point.

5. The refining element of claim 1 wherein said plurality of recesses have a depth of from 2 to 5 mm as measured from said longitudinal edge.

6. The refining element of claim 5 wherein said plurality of recesses are disposed substantially across said plurality of bars.

7. The refining element of claim 1 wherein said plurality of recesses form an angle of from 45° to 90° with respect to said plurality of bars, as measured in the intended direction of flow of said fibrous material along said refining surface.

* * * * *